US008439596B1

(12) United States Patent
Dvoracek

(10) Patent No.: US 8,439,596 B1
(45) Date of Patent: May 14, 2013

(54) TEXTURED TILE SYSTEM AND INSTALLATION METHOD

(76) Inventor: Joe Dvoracek, Burbank, CA (US)

( * ) Notice: Subject to any disclaimer, the term of this patent is extended or adjusted under 35 U.S.C. 154(b) by 0 days.

(21) Appl. No.: 13/567,254

(22) Filed: Aug. 6, 2012

(51) Int. Cl.
*E01C 9/00* (2006.01)

(52) U.S. Cl.
USPC ..... 404/19; 404/42; 52/177

(58) Field of Classification Search ..... 404/19, 404/28, 33, 34, 35, 42; 52/177, 181, 384, 52/389
See application file for complete search history.

(56) References Cited

U.S. PATENT DOCUMENTS 348,782 A * 9/1886 Sawyer ..... 52/177
D140,623 S * 3/1945 Harper ..... D25/160
3,950,908 A * 4/1976 Van Eyk ..... 52/436
5,281,459 A * 1/1994 Van Eijck ..... 428/100
6,074,127 A * 6/2000 Suetsugu ..... 404/36
6,467,224 B1 * 10/2002 Bertolini ..... 52/177
6,718,714 B1 * 4/2004 Montgomery, Sr. ..... 52/392
D594,564 S * 6/2009 Disch et al. ..... D25/69
7,779,581 B2 * 8/2010 Flaherty et al. ..... 52/177
7,827,928 B2 * 11/2010 Shaw et al. ..... 116/205
7,845,122 B2 * 12/2010 Sippola ..... 52/177
7,955,024 B2 * 6/2011 Driscoll et al. ..... 404/19
8,028,491 B2 * 10/2011 Flaherty et al. ..... 52/747.11

* cited by examiner

*Primary Examiner* — Gary S Hartmann
(74) *Attorney, Agent, or Firm* — Patent Law & Venture Group; Gene Scott

(57) ABSTRACT

A detectable warning tile is a molded sheet having generally planar top and bottom surfaces, the top surface having a plurality of spaced apart truncated domes in relief thereon, the bottom surface having a grid pattern of depressions therein. Partitions rising from the bottom surface are positioned within the interior of the domes and are integral therewith. The bottom surface may have an adhesive layer for bonding with a solid under-surface. Alternately, anchors may be engaged with the bottom surface for securing the tile in a uncured cement, concrete or blacktop surface.

8 Claims, 7 Drawing Sheets

TEXTURED TILE SYSTEM AND INSTALLATION METHOD

BACKGROUND

This disclosure relates generally to pedestrian platforms, walkways and sidewalks and more particularly to pedestrian platforms, walkways and sidewalks for the blind and visually impaired. There is often the need, in public transit facilities, for pedestrians to detect the location of a public transportation platform or other pedestrian surface that may present a potential hazard. By making the pedestrian aware of a specific location a potential danger may be avoided. By way of example, this may include railroad crossings, subway platforms, loading docks, stages, stairways, sidewalks, curb ramps, crosswalks, man holes, potholes, and so on.

The Americans with Disabilities Act (ADA): "Accessibility Guidelines for Buildings and Facilities" sets the requirements for the use of detectable warnings at curb ramps, walking surfaces, transit platforms and the like to warn visually impaired people of hazards. The guidelines require that detectable warnings shall consist of truncated domes with a diameter nominal of 0.9" (23 mm), a height nominal of 0.2" (5 mm), a center-to-center spacing nominal of 2.35" (60 mm), and shall contrast visually with adjoining surfaces, either light on dark or dark on light. The material used to provide contrast shall be an integral part of the walking surface. Detectable warnings used on interior surfaces are required to differ from adjoining surfaces in resiliency or sound-on-cane contact. Platform edges bordering a drop off and not protected by screens or guard rails shall have a detectable warning 24 inches wide running the full length of the platform drop off. If a walkway crosses or adjoins a vehicular way, and the walking surface is not separated by curbs, railing or other element between the pedestrian areas and the vehicular areas, the boundary between such area is to be identifiable by a continuous detectable warning 36 inches wide. Curb ramps are also required to have detectable warnings extending the full width and depth of the curb ramp.

Known within the art are tiles designed to be glued or mechanically fastened to an existing walking surface. U.S. Pat. No. 4,715,743 issued to Schmanski discloses a uniform adhesive layer applied to a tile, which is then adhered to a surface. Tiles installed according to this method are not meant to be flush with the ground and may come undone due to abrasion at their exposed edges. Also known within the art is the use of a patterned tool to produce a durable tactile warning surface for sidewalks and other walkways including pouring a concrete base, applying pigmented or colored hardener to the upper surface of the concrete base and stamping the upper surface of the base with a patterned tool. This can be relatively costly. Also, there is room for imperfections and errors.

Adherence of a tile to a walkway surface is a critical aspect of the present tiled surface requirement. Prior efforts to retain a tile in an attached position have been frustrated by separation of the peripheral edge of the tile from the pavement. Such separation can present a danger to the visually impaired rather than solve the intended problem in the first place. Prior attempts to solve this problem have included the stamping of concrete, and the use of plastic tiles with chamfered edges. However, as mentioned, stamping is costly, prone to errors, labor intensive and requires on site work. Some plastic materials that have been used for pedestrian tiles are fragile and subject to lifting from their base surface. Accordingly, what is needed is a textured tile system and method of installation that allows for pre-cast tiles to be easily installed, that are installed flush with the base surface, and that may be installed without significant labor, and that are in compliance with ADA requirements.

SUMMARY

A textured tile system is described herein along with methods of installation that meet the above mentioned need. Such a tile system may be embedded in freshly poured cement, asphalt, blacktop or other materials normally used for forming a pedestrian walking surface. Such a tile system may also be mechanically secured to an existing hard surface by anchors or an adhesive layer. The textured tile may be installed and incorporated on a surface so as to provide visual and tactile warnings as one approaches and walks on the tile's exposed surface. This may be particularly useful to disabled individuals and in particular the visually impaired to know when they are approaching a curb or other change in surface elevation.

According to one aspect of this disclosure, a pre-cast textured individual tile may be formed as a substantially planar sheet of a convenient size with a top surface and a bottom surface. The top surface may have a plurality of raised elements and the bottom surface may be configured with depressions for engagement with the underlying surface to which the tile is engaged.

According to another aspect of this disclosure, a textured tile system may be made up of a plurality of the individual tiles which may be mounted on a common underlying surface in an edge to edge arrangement to form a greater tile surface area of any desired size.

According to another aspect of this disclosure, the raised elements may be configured as truncated dome structures and the depressions may extend from the bottom surface into the interior of the raised elements.

According to another aspect of this disclosure, the textured tiles may be mounted on an existing surface and secured thereto by a layer of adhesive and by mechanical anchors.

The details of one or more embodiments of these concepts are set forth in the accompanying drawings and the following description. Other features, objects, and advantages of these concepts will be apparent from the description and drawings, and from the claims.

DESCRIPTION OF DRAWINGS

Like reference symbols in the several drawings indicate like elements.

DETAILED DESCRIPTION

Figure 1:
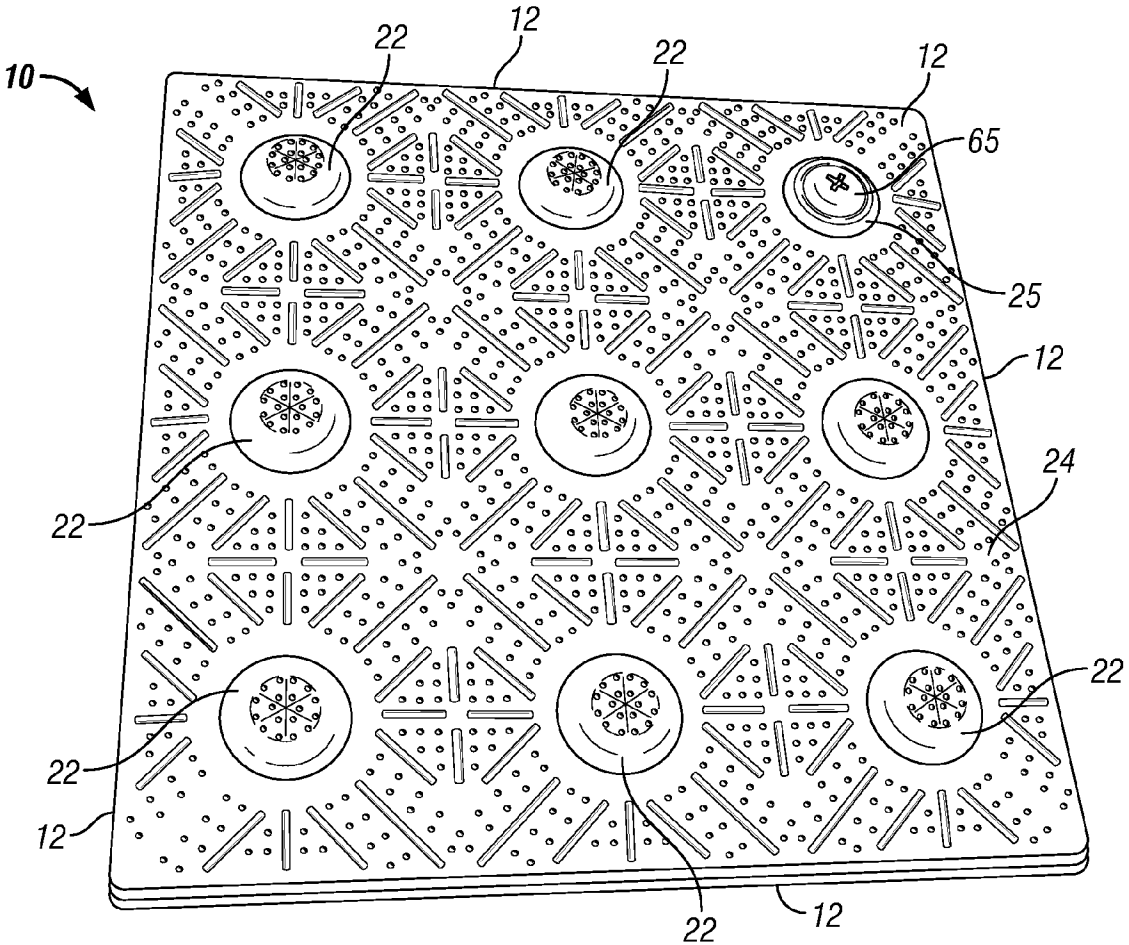
FIG. 1 is an example perspective view of the presently described and claimed warning tile showing a top surface thereof having an array of domes and a relief pattern.

FIG. 1 shows the presently described tactile warning tile 10 which may be of an injection molded or cast sheet construction of polyurethane material or other substance and may have a thickness of at least ⅛ inch. A peripheral edge 12 may be flat or near flat. The tile 10 may be rectangular in shape as shown in the illustrations, but may alternately be round, triangular or any alternate shape desired and may be any practical size.

Figure 3:
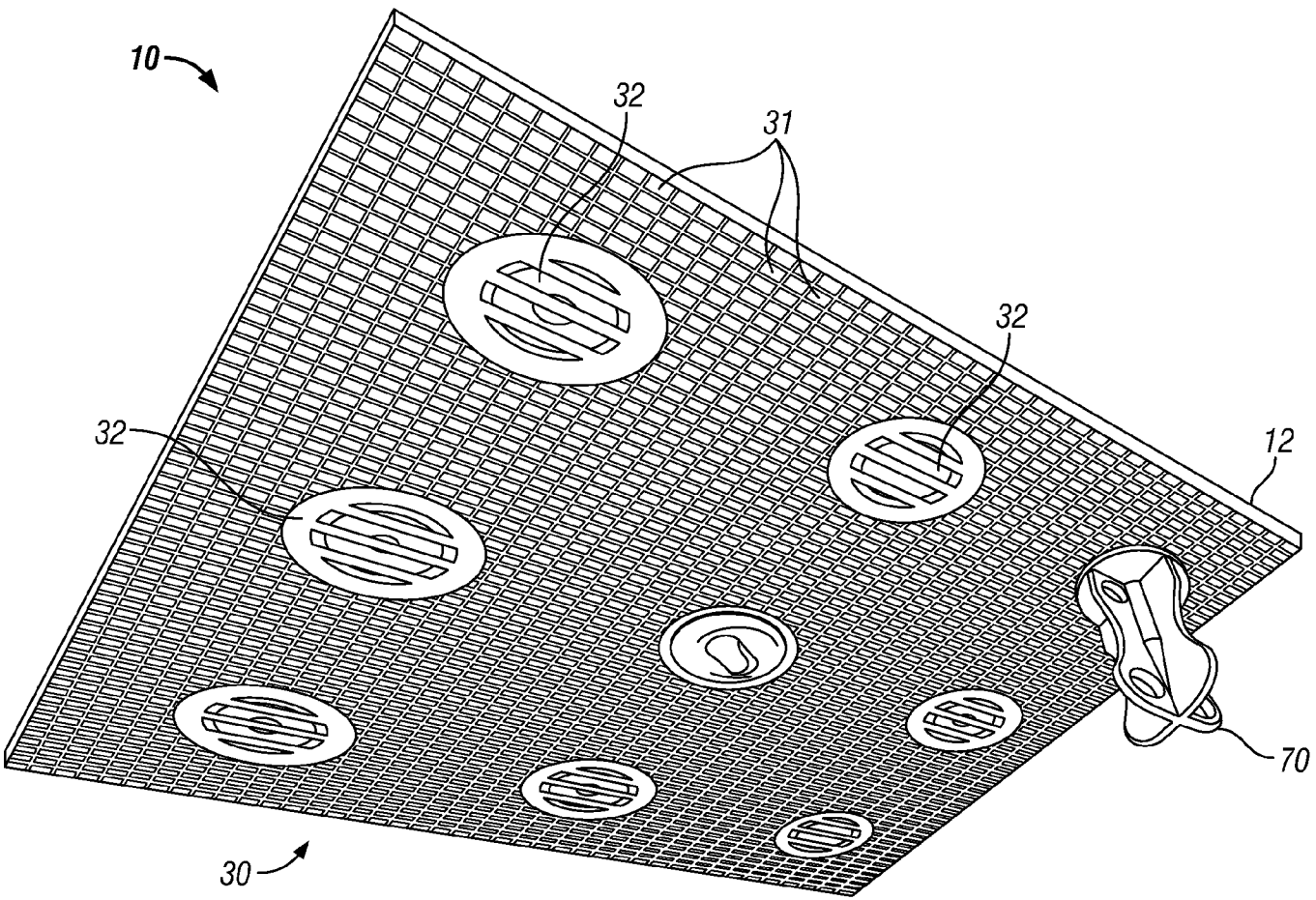
FIG. 3 is an example bottom perspective view of a second embodiment thereof.
Figure 4:
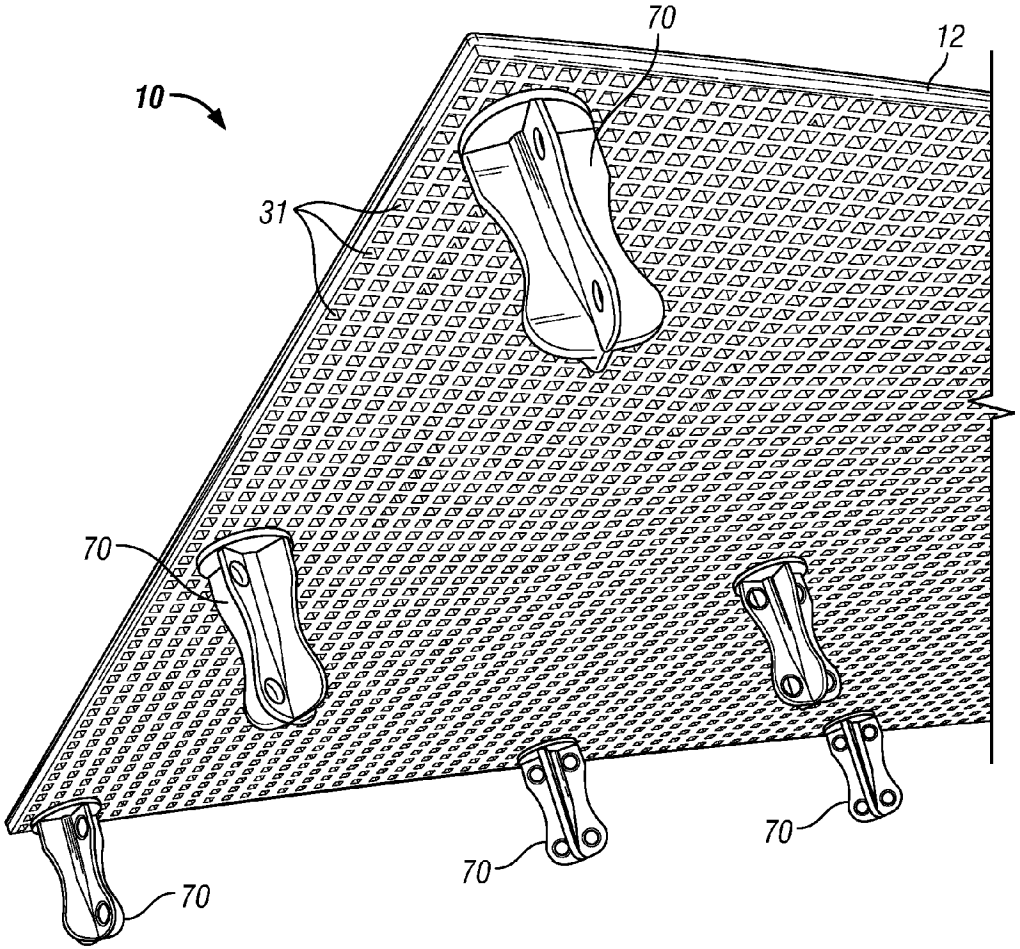
FIG. 4 is an example further perspective view of the second embodiment thereof.

Tile 10 has a top surface 20 as shown in FIG. 1, and a bottom surface 30 as shown in FIGS. 3 and 4. The top surface 20 may have a plurality of spaced apart truncated domes 22 which extend in relief to the generally planar nature of surface 20. Also linear and pimple relief elements form a pattern on top surface 20. These relief features enable tactile feedback to those walking over the top surface 20 as shown in FIG. 8, and also provide for stable walking when tile 10 is wet or icy. The bottom surface 30 may have a recessed grid pattern of open holes 31 as best illustrated in FIGS. 3 and 4. Directly below each one of the domes 22, the bottom surface 30 may provide a plurality of spaced apart grill openings 32, wherein the grill openings 32 define positions of partitions 33 which extend from the bottom surface 30 vertically upward inside the domes 22 and are formed integral therewith, whereby, the partitions 33 support the domes 22 and the grill openings 32 provide space for a freshly poured cement, concrete, or blacktop underlying material to flow into and fill the domes 22. This structural relationship is shown in the cross-sectional views of FIGS. 6 and 7 and provides the strength necessary to prevent the domes 22 from being crushed under pedestrian foot traffic, bicycles, carriages and so forth. The hollow and recessed portions of tile 10 provide strength in flexure while reducing overall weight.

Figure 2:
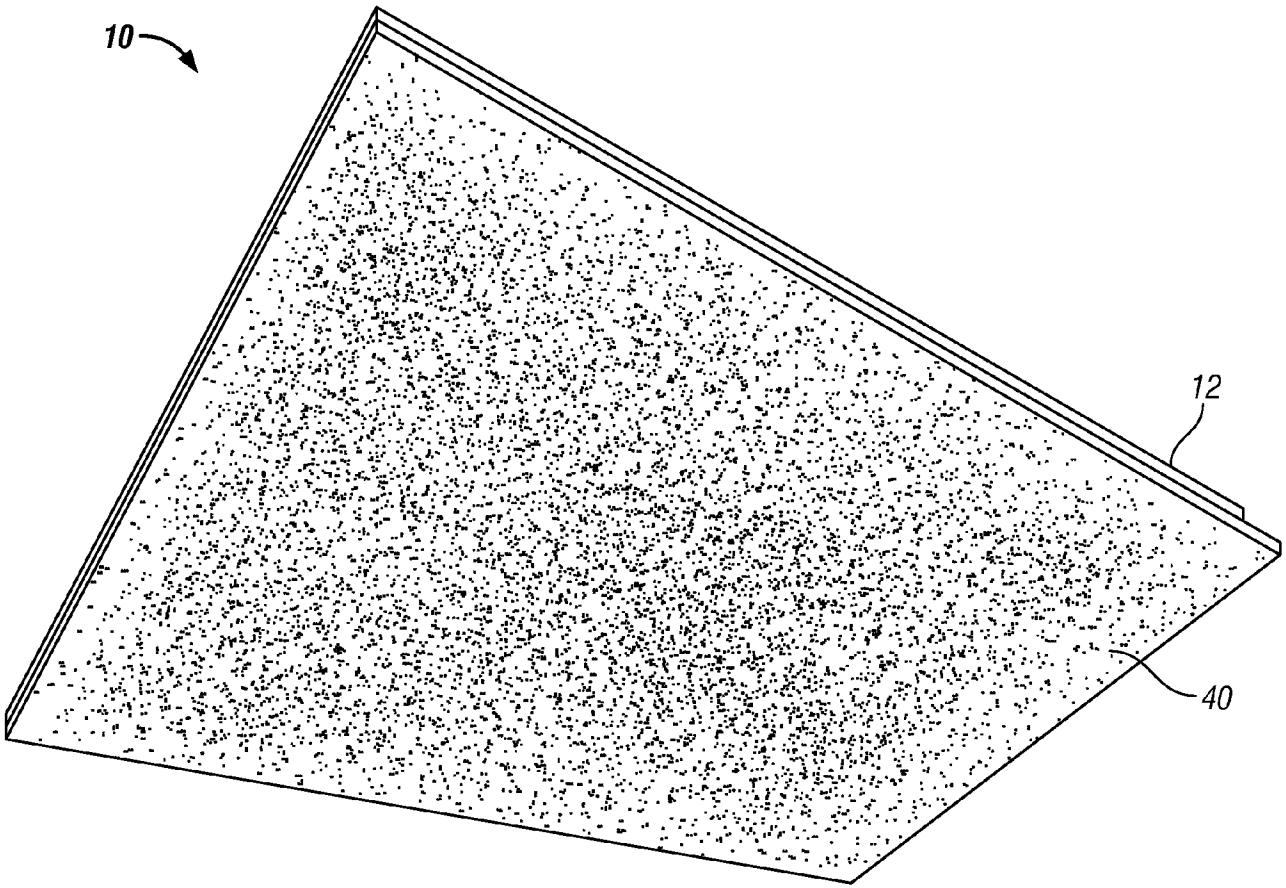
FIG. 2 is an example bottom perspective view of a first embodiment thereof.
Figure 6:
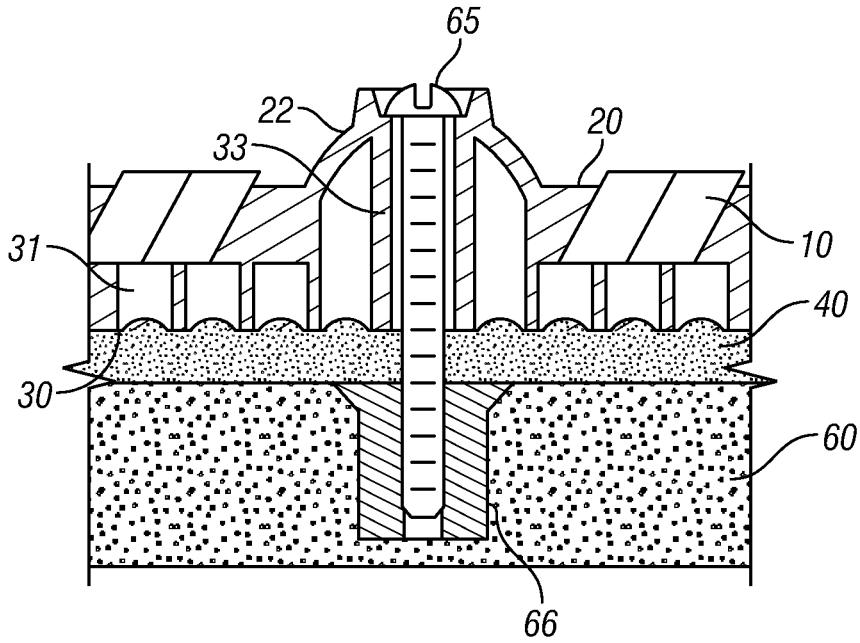
FIG. 6 is an example vertical cross-sectional view through one of the domes of the first embodiment illustrating an example method of securing the tile to a fixed surface.

In one embodiment of tile 10, shown in FIG. 2, a relatively soft adhesive layer 40 may be applied over the bottom surface 30. The adhesive layer 40 may be well secured to bottom surface 30 as it extrudes into holes 31 as shown in FIG. 6. When tile 10 is placed, the adhesive layer 40 is pressed against a generally planar sidewalk surface 60 such as set concrete and may be secured in place by screws 65 as shown in FIG. 6.

Figure 5:
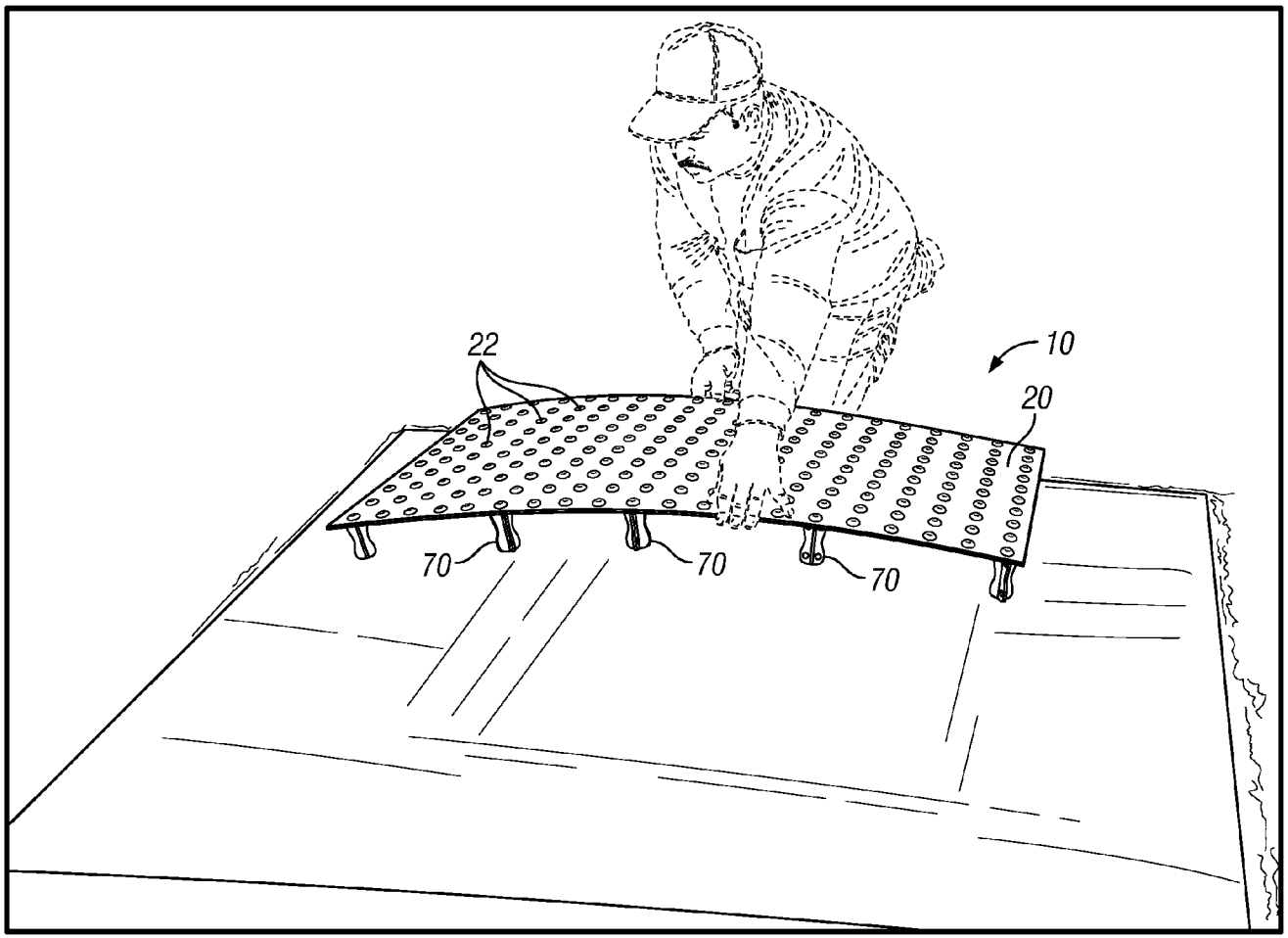
FIG. 5 is an example perspective view of the second embodiment being placed into a bed of wet cement.
Figure 7:
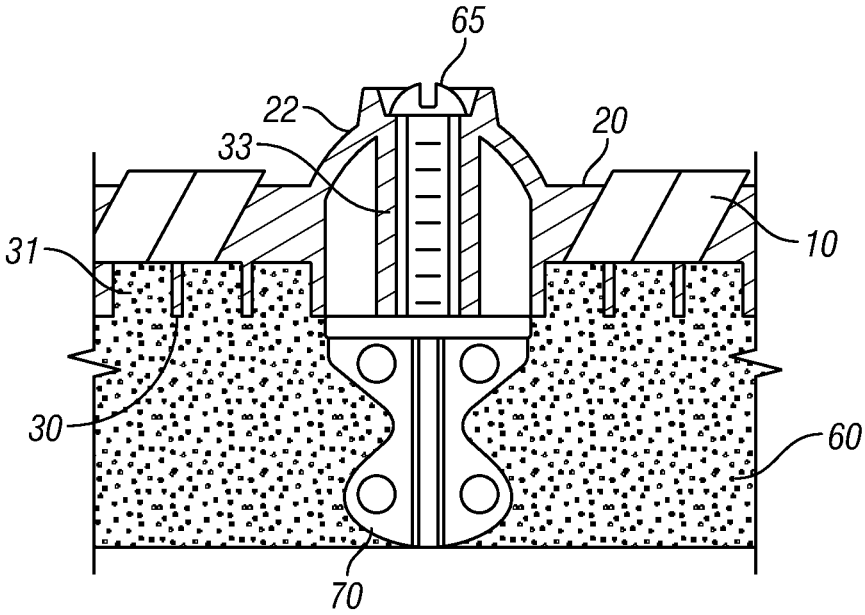
FIG. 7 is an example vertical cross-sectional view through one of the domes of the second embodiment illustrating an example method of securing the tile to a wet surface.
Figure 8:
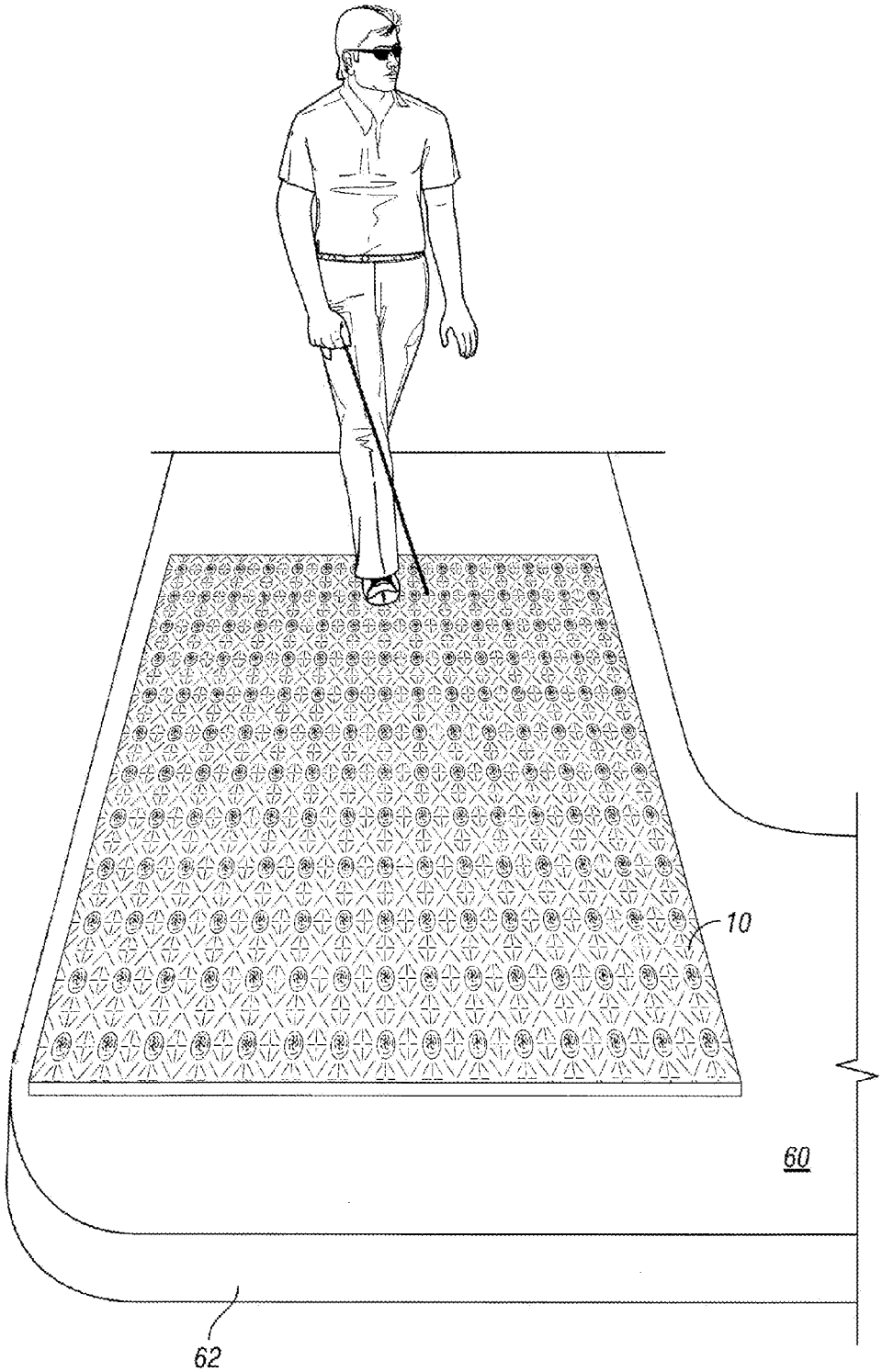
FIG. 8 is an example perspective view of the warning tile as mounted in a walking surface and its use illustrated.

In another embodiment of tile 10, anchors 70 are attached over the grill bars 32 as shown in FIGS. 3 and 4 and secured in place with screws 65 as shown in FIG. 7. When the tile 10 is pressed into a base of wet cement as shown in FIGS. 5 and 7, the anchors 70 are gripped by the cement and stabilized monolithic structure results.

As shown and described above, the top surface 20 may have a relief pattern 24 of pimples and linear elements as just one example of this concept. Relief pattern 24 may include spaced apart elements which extend upwardly from a more-or-less generally planar surface 20 as shown in FIG. 1. The relief pattern 24 provides a safe, non-skid footing when walking on surface 20 and especially when rain or snow/ice is present or when sand or dirt collects on the top surface 20. The linear elements are not mutually joined which allows water to flow and debris to roll off the top surface 20 without being captured between the elements of relief pattern 24. Also, most of the linear elements are positioned at an acute angle with respect to the edges 12 of tile 10 thereby providing an unrestricted path for water and debris to move off the top surface 20 especially if the top surface 20 is not exactly horizontal. A second relief pattern 26 may be formed on the tops of the truncated domes 22. This second relief pattern 26 provides a non-skid surface under foot.

FIG. 8 clearly shows that when a visually impaired individual walking on underlying surface 60 approaches a curb 62, the system of tiles 10 is able to provide a tactile warning of an impending change in surface level or character such as a curb 62.

A number of embodiments have been described. Nevertheless, it will be understood that various modifications may be made without departing from the spirit and scope of this disclosure. Accordingly, other embodiments are within the scope of the following claims.

What is claimed is:

1. A warning tile comprising:

a rigid plate having a top surface, and a bottom surface;

a plurality of spaced-apart hollow domes extending in relief to the top surface;

a plurality of grill openings in the bottom surface, each one of the grill openings positioned in opposition to one of the domes; and a plurality of spaced apart partitions extending from the bottom surface within each of the hollow domes and integral therewith;

the hollow domes, partitions, and grill openings defining a space for receiving a cementitious material.

2. The tile of claim 1 further comprising a soft adhesive layer covering at least a portion of the bottom surface.

3. The tile of claim 1 wherein the top surface has a relief pattern between the truncated domes, the relief pattern comprising spaced apart linear elements and pimples.

4. The tile of claim 3 wherein the linear elements are discontinuous.

5. The tile of claim 1 wherein the hollow domes each have an exterior surface with a pimple pattern thereon.

6. The tile of claim 1 wherein the bottom surface has a pattern of recesses therein.

7. The tile of claim 1 further comprising a concrete anchor secured to the bottom surface and aligned with one of the plurality of domes.

8. The tile of claim 7 wherein the concrete anchor has plural, radially arrayed legs with at least one of the legs having at least one through hole therein.

* * * * *